US010094162B2

(12) United States Patent
Snape

(10) Patent No.: US 10,094,162 B2
(45) Date of Patent: Oct. 9, 2018

(54) FLOOD SEAL ARRANGEMENT

(71) Applicant: William M Snape Manufacturing Services (UK) Limited, Leyland (GB)

(72) Inventor: Malcolm Snape, Preston (GB)

(73) Assignee: WILLIAM M SNAPE MANUFACTURING SERVICES (UK) LIMITED, Leyland, Lancashire (GB)

( * ) Notice: Subject to any disclaimer, the term of this patent is extended or adjusted under 35 U.S.C. 154(b) by 0 days.

(21) Appl. No.: 15/341,271

(22) Filed: Nov. 2, 2016

(65) Prior Publication Data

US 2017/0122024 A1 May 4, 2017

(30) Foreign Application Priority Data

Nov. 2, 2015 (GB) ..... 1519360.0

(51) Int. Cl.

| | |
|---|---|
| ***E06B 7/16*** | (2006.01) |
| ***E06B 1/70*** | (2006.01) |
| ***E06B 5/16*** | (2006.01) |
| ***E06B 7/23*** | (2006.01) |

(52) U.S. Cl.

CPC ..... *E06B 1/70* (2013.01); *E06B 5/164* (2013.01); *E06B 7/2312* (2013.01); *E06B 7/2316* (2013.01)

(58) Field of Classification Search

CPC ..... E06B 1/70; E06B 7/2316; E06B 5/164; E06B 7/2312

USPC ..... 49/469, 470, 483.1

See application file for complete search history.

(56) References Cited

U.S. PATENT DOCUMENTS

| | | | | | |
|---|---|---|---|---|---|
| 301,221 | A * | 7/1884 | Devers | E06B 7/232 | 296/93 |
| 671,786 | A * | 4/1901 | Allison | E06B 7/232 | 49/383 |
| 975,337 | A * | 11/1910 | Dumont | E06B 7/232 | 49/483.1 |
| 1,270,869 | A * | 7/1918 | Relling | E06B 7/232 | 16/86 A |
| 1,795,853 | A * | 3/1931 | Glass | E06B 7/232 | 49/470 |
| 1,842,734 | A * | 1/1932 | Saives | E05F 7/04 | 16/86 A |

(Continued)

FOREIGN PATENT DOCUMENTS

| | | | |
|---|---|---|---|
| EP | 0 568 949 | A1 | 11/1993 |
| GB | 839523 | A | 6/1960 |

(Continued)

OTHER PUBLICATIONS

European Search Report dated Mar. 10, 2017 for AP Application No. 16196809.4.

*Primary Examiner* — Jerry E Redman

(74) *Attorney, Agent, or Firm* — Shumaker, Loop & kendrick, LLP

(57) ABSTRACT

A flood seal arrangement, and particularly to a flood seal arrangement suitable for a low threshold door, that includes a first gasket member and a second gasket member. The first gasket member may be provided on a door leaf, while the second gasket member may be provided on a threshold. The first and the second gasket member are configurable to engage and thereby form a seal. In response to water pressure, the flood seal arrangement may be deformed and the seal may be improved.

10 Claims, 5 Drawing Sheets

(56) References Cited

U.S. PATENT DOCUMENTS

| | | | | | |
|---|---|---|---|---|---|
| 1,973,461 | A * | 9/1934 | Barringer | E06B 7/232 | 49/383 |
| 2,663,056 | A * | 12/1953 | Hardgrave | E06B 7/205 | 49/305 |
| 2,752,015 | A * | 6/1956 | Nolan | E06B 7/232 | 49/483.1 |
| 2,976,584 | A * | 3/1961 | Ghormley | E06B 1/70 | 49/469 |
| 4,513,536 | A * | 4/1985 | Giguere | E06B 1/70 | 49/470 |
| 6,061,967 | A | 5/2000 | Judds | | |
| 8,813,427 | B2 * | 8/2014 | Meeks | E06B 1/70 | 49/467 |
| 2006/0283087 | A1 * | 12/2006 | Baxter | E06B 7/20 | 49/306 |
| 2013/0199100 | A1 * | 8/2013 | Van Camp | E06B 1/70 | 49/468 |

FOREIGN PATENT DOCUMENTS

| | | | | |
|---|---|---|---|---|
| GB | 2184153 A * | 6/1987 | | E06B 7/2314 |
| GB | 2 479 470 A | 10/2011 | | |

* cited by examiner

FLOOD SEAL ARRANGEMENT

FIELD

The present disclosure relates to a flood seal arrangement which is suitable for a door and particularly for a low threshold door.

BACKGROUND

Flooding of a building may cause significant damage and long-term detriment to a building, irrespective of damage caused to any contents of the buildings. It may therefore be desirable to have adequate flood protection suitable for preventing flood water from entering the building. Flood water may enter a building through any building element forming an opening in the building, such a door or a window. A door at ground level may be the first point of entry for flood water. Even when fully closed, it may still be possible for flood water to flow past the door and enter the building.

A known form of permanent flood protection involves a flood seal provided in the door such that the door is sealed whenever it is shut. More precisely, a gasket formed from a resilient material may be provided on the door frame and, alternatively or additionally, a similar gasket may be arranged on the door leaf. Upon closing the door, the gasket seals a gap that is formed between the door leaf and the frame. However, water may still enter the building by seeping through the seal formed by the gasket. While a larger gasket may reduce seepage, such an arrangement may require increased force for shutting the door. For a low threshold door, however, a larger gasket is not an option as a low threshold door has a maximal height according to building regulations.

SUMMARY

It is an object of the present invention to overcome at least one of the above or other disadvantages. It is an aim of the present invention to provide a flood seal arrangement that reduces seepage of flood water through a sealed door. It is a further aim of the present invention to provide a flood seal arrangement that is suitable for a low threshold door. It is a further aim of the present invention to provide a flood seal arrangement suitable for other building elements.

A flood seal arrangement according to the present invention comprises a first gasket member and a second gasket member. The first and the second gasket member are engageable to form a seal between the first and the second gasket member. Suitably, the first and the second gasket member may be pressed together to form the seal. Advantageously, the seal formed by the first and the second gasket member may be improved in response to water pressure acting on the seal.

The first gasket member forms a first portion and a protrusion. The protrusion extends from the first portion. Conveniently, the protrusion may project from a first surface formed by the first portion at a generally right angle with respect to the first surface. Alternatively, the protrusion may project from the first surface at some other angle. The protrusion may be resiliently deformable. That is, a first shape of the protrusion may be deformable to a second shape and, when in the second shape, the protrusion is configured to assume a shape generally matching the first shape.

When arranged to form the seal, the first gasket member may press against the second gasket member. Thereby the second gasket member may abut the protrusion of the first gasket member. When the seal is formed, the protrusion is located in a recess extending into a second portion of the second gasket member. Advantageously, when the protrusion is located in the recess, a deformation of the protrusion may be opposed by the second portion. In particular, a deformation of the protrusion in response to water pressing against the protrusion may be prevented when the second portion abuts the protrusion.

The first gasket member may be suitable for fastening to a door leaf, while the second gasket member may be suitable for fastening to a door threshold. Suitably, here, reference to a door leaf and a door threshold is reference to a door system that pivots about a substantially vertical axis. Consequently, the gasket members along the lowest edge of the door leaf and threshold move towards and away from each other in one plane only. For instance when the door is mounted about a vertical axis, the plane would suitably be horizontal. This contrasts to a door system that opens by pivoting about a horizontal axis wherein the gaskets about the lowest edge move simultaneously in first and second orthogonal planes.

When arranged to form the seal, the first and the second gasket member are separable to break the seal. In particular, the protrusion is removable from the recess.

The recess may be pre-formed or, alternatively, may be formed as a result of the protrusion pressing against the second gasket member.

The first gasket member may form a plurality of protrusions. When the first and the second gasket member are arranged to form a seal, the second gasket member may abut the plurality of protrusions. Suitably, when the first and the second gasket member form the seal, the plurality of protrusions of the first gasket member may be located in a plurality of recesses in the second gasket member. Conveniently, the number of protrusions of the first gasket member may correspond to the number of recesses extending into the second gasket member. Advantageously, the plurality of protrusions, allow misalignment of the gaskets to be tolerated, however, it is thought only the first one of the flexible protrusions in correct contact provides the waterproofness to the seal.

The plurality of protrusions may be arranged such that the first gasket member may be installed upside-down without affecting the performance of the flood seal arrangement. Suitably, the plurality of protrusions is arranged symmetrically. Similarly, the second gasket member may be symmetrical.

An outermost protrusion of the plurality of protrusions may be arranged to project away from a neighbouring protrusion. The outermost protrusion has only a single neighbouring protrusion, while other protrusions may have a neighbouring protrusion on either side. Advantageously, the seal formed may be improved when the outermost protrusion is arranged to project away from its neighbouring protrusion as thereby the outermost protrusion may be configured to oppose water pressure. In the exemplary embodiments, an outermost tip of the protrusion is arranged to bend outwardly toward the side exposed to water. That is, the neighbouring protrusion is arranged on the dry side of the outermost protrusion.

When the first and the second gasket member are arranged to form the seal, at least one of the gasket members may be deformed. In one example, both the first and the second gasket member may be deformed. Suitably, the first and/or the second gasket member may be made from a resiliently deformable material.

According to an exemplary embodiment there is provided a door assembly comprising the flood seal arrangement according to the present invention.

The door assembly comprises a door leaf and a threshold. The first gasket member is fastened to the door leaf, while the other is fastened to the threshold. Any suitable fastening means may be used for fastening a gasket member. For example, a gasket member may be retained mechanically.

The first gasket member may extend along the door leaf, while the second gasket member may extend along the threshold. The second gasket member may be configured to have a height not exceeding the height of the threshold. The height of the second gasket member may be arranged to exhaust the height of the threshold. The height of the threshold may be 15 mm.

Advantageously, the first and the second gasket member can be installed in an upside-down orientation without any difference to the performance of the seal. Suitably, the first and the second gasket member are symmetrical.

The door assembly may be operable, by closing the door, so that the first gasket member engages the second gasket member and a seal is formed.

The door may be arranged to open inwardly or outwardly. That is, the door may be arranged such that when it is opened, the door leaf is substantially located on the inside of the building or, alternatively, the door leaf is substantially located outside of the building.

In an exemplary embodiment, the flood seal arrangement comprises a first gasket that seals against a second gasket to form a watertight seal when the two seals move respectively towards each other in a closing direction. The first gasket has a protrusion that is arranged to locate adjacent a portion of the second gasket. The protrusion is flexible in a direction transverse the closing direction. Here, the protrusion flexes towards the adjacent portion of the second gasket under external water pressure. Advantageously, as well as pressing against the second seal in the closing direction, the protrusion flexes in a direction transverse the closing direction to press against an adjacent portion of the second seal that extends in the closing direction. In one exemplary embodiment, the adjacent portion of the second gasket forms a recess in the closing direction. Suitably, more than one pairs of cooperating protrusions and adjacent portions may be formed.

Advantageously, the door is outward opening. An outward-opening door is configured such that pressure exerted onto the outward-opening door by flood water urges the first gasket member against the second gasket member. Thereby the flood seal arrangement may be compressed and the seal may be improved.

DESCRIPTION OF EMBODIMENTS

Exemplary embodiments of a flood seal arrangement according to the present disclosure are discussed with reference to the Figures. It will be appreciated that the flood seal arrangement is presented schematically in the Figures and that technical details have been omitted for the sake of clarity, or where such details are well known in the art.

Figure 1:
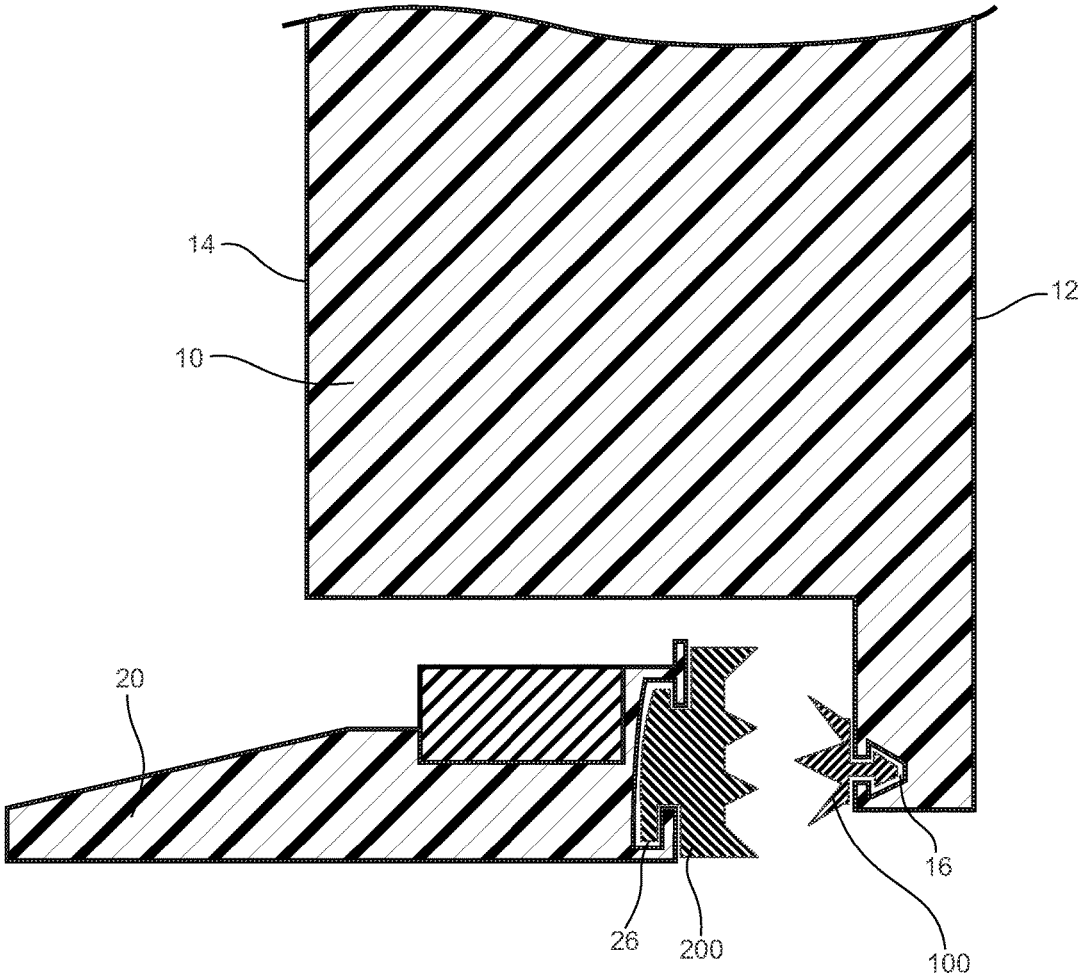
FIG. 1 shows a cross-sectional view of an embodiment of a flood seal arrangement according to the present invention provided on a door that is partly open.

FIG. 1 shows a cross-sectional view of an exemplary embodiment of a flood seal arrangement according to the present invention.

The door assembly comprises a door leaf 10, a threshold 20 and a door frame. In this example, the threshold 20 is a low threshold. According to building regulations, there may be a height restriction for a low threshold door. The height restriction on the threshold 20 may be 15 mm.

The door assembly is suitable for allowing access to a building and may be arranged for outward opening or inward opening with respect to the building. In this example, the door leaf 10 is arranged for outward opening. That is, the door leaf 10 is movable across an area located outside of the building. When the door leaf 10 is in a closed position, a first side 12 of the door leaf 10 faces an outside area, while a second side 14 faces an inside area of the building.

The flood seal arrangement is configured to seal the door assembly when the door leaf 10 is in the closed position. Suitably, the flood seal arrangement comprises a first gasket member 100 and a second gasket member 200. In this example, the first gasket member 100 and the second gasket member 200 are not of identical shape.

In the closed position, the door leaf 10 may engage the threshold 20 and the door frame. However, a gap may be formed between the door leaf 10 and the threshold 20 such that flood water may enter the building when the door leaf 10 is in the closed position. The gasket is arranged such that the gap may be sealed when the door leaf 10 is in the closed position. Similarly, a gap may be formed between the door leaf 10 and the door frame, and the present invention may be equally applicable for sealing the gap between door leaf 10 and door frame.

The first gasket member 100 is fastened to the door leaf 10. Any means suitable for securing the first gasket member 100 to the door leaf 10 may be used. Such means may include gluing the first gasket member 100 to the door leaf 10. In this example, however, the first gasket member 100 is retained mechanically in a channel 14 formed by the door leaf 10.

It may be desirable to fit the first gasket member 100 to the door leaf 10 such that no gap is formed between the two. Otherwise, flood water may seep past the first gasket member. A gap may be sealed using any suitable means. In some example, silicone or glue may be used. In this example, the first gasket member 100 is mechanically retained by the door leaf 10 such that the first gasket member 100 is tightly pressed against the door leaf 10.

In this example, pressure exerted by flood water on the door leaf 10 is arranged to improve sealing of the gap between the first gasket member 100 and the door leaf 10. Advantageously, water pressure exerted on the first side 12 of the door leaf 10 urges the door leaf against the threshold 20 so that the flood seal arrangement is compressed. In particular, any gap formed between the first gasket member 100 and the door leaf 10 may be closed in response to the water pressure pressing against the door leaf 10.

The second gasket member 200 is secured to the threshold 20. As described in relation to the first gasket member 100, the second gasket member 200 may be secured using any suitable means. In this example, the second gasket member 200 is held in place mechanically, being retained in a channel 26 formed by the threshold 20.

Any gap that may be formed between the second gasket member 200 and the threshold 20 may be sealed using any suitable means. In this example, the door leaf 10 is arranged to retain the second gasket member 200 mechanically such that the second gasket member 200 is pressed against the threshold 20. In this example, water pressure exerted against the first side 12 of the door leaf 10 is arranged to compress the flood seal arrangement. Thus any gap between the second gasket member and the threshold may be further compressed.

It may be desirable that the second gasket member 200 does not exceed the height of the threshold 20, for example in order to meet building regulations or to prevent damage to the second gasket member 200 from passage of the threshold 20. In this example, the threshold 20 and the second gasket member 200 each have a height of 15 mm.

Figure 2:
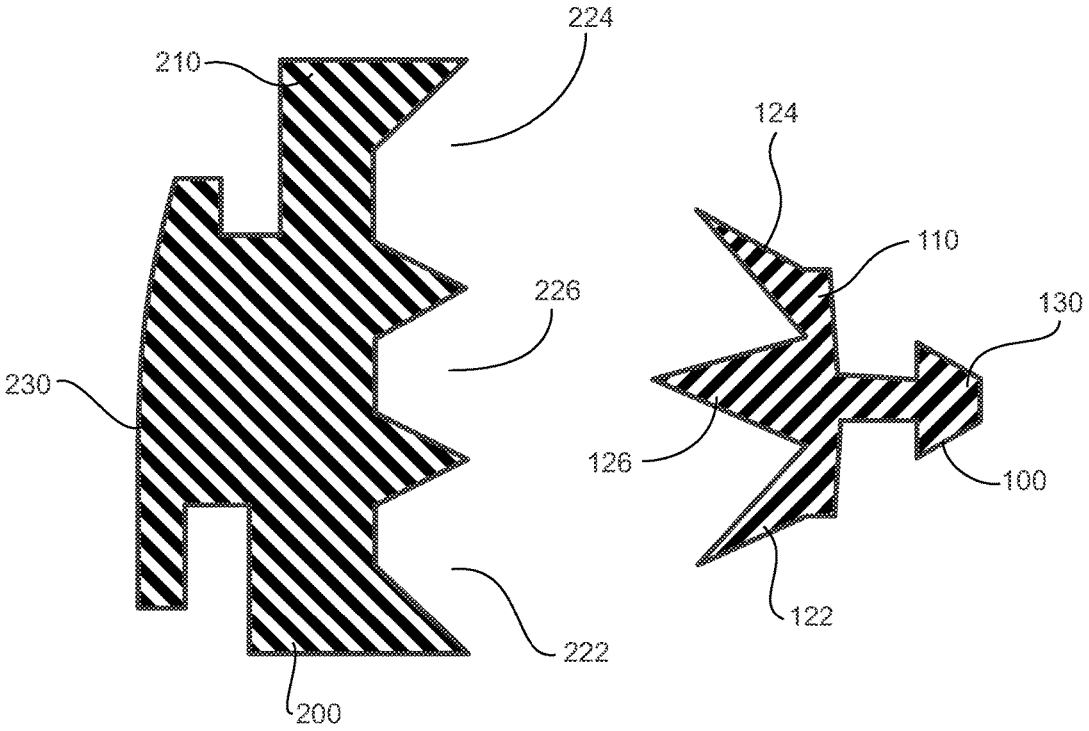
FIG. 2 shows a cross-sectional view of an embodiment of a flood seal arrangement according to the present invention.

FIG. 2 shows the first gasket member 100 and the second gasket member 200.

The first gasket member 100 forms a first portion 110. In this example, a plurality of protrusions 122, 124, 126 extends from the first portion 110. A protrusion 122, 124 or 126 may have a generally triangular cross-section.

In this example, the protrusions 122 and 124 have only a single neighbouring protrusion. That is, the protrusion 122, 124 is located on an outermost region of the first gasket member 100.

The protrusion 126 is located generally centrally on the first gasket member 100, and has a neighbouring protrusion on either side.

The protrusions 122, 124, 126 may project from the first portion 110 at a generally right angle. Alternatively, the protrusions 122, 124, 126 may extend, individually or collectively, at some other angle. In this example, the outermost protrusions 122 and 124 extend from the first portion 110 such that they are directed away from the protrusion 126. In particular, the protrusions 122 and 124 also extend past the first portion 110. Thereby an increased area of the second gasket member 200 may be engageable by the first gasket member 100.

The protrusions 122, 124 and 126 are adjacent to one another. That is, no gap is formed between two neighbouring protrusions. In this example, the protrusions 122 and 124 are adjacent to one another. Similarly, the protrusions 124 and 126 are adjacent.

In this example, the first gasket member 100 is retained mechanically by the door leaf 10. Suitably, the first gasket member 100 forms a first head portion 130. The first head portion 130 is configured to be received by the channel 16 and engaged by the door leaf 10. The first gasket member 100 may thus be retained by the door leaf 10.

It may be advantageous for the first gasket member 100 to be installable in an upside-down orientation without affecting performance of the first gasket member 100. Suitably, the plurality of protrusions 122, 124, 126 is arranged symmetrically on the first portion 110. Similarly, the first head portion 130 is symmetrical. That is, the first gasket member is effectively unchanged after turning the first gasket member upside-down.

The second gasket member 200 forms a second portion 210. In this example, a plurality of recesses 222, 224, 226 extending into the second portion 210 is formed and the recesses are uniformly spaced. Each recess 222, 224, 226 has a depth, and the depth of all recesses may be substantially identical. The recess 222, 224, 226 may have a generally triangular cross-section, and may be shaped such that a close fit is formable between the protrusion 122, 124, 126 and the recess 222, 224, 226. In this example, the recesses 222, 224 and 226 have the same shape, but in another example they may have differing shapes.

In this example, the first gasket member 100 and the second gasket member 200 are configurable such that the protrusion 122 is located in the recess 222, the protrusion 124 is located in the recess 224, and the protrusion 126 is located in the recess 226.

In this example, the second gasket member 200 is retained mechanically by the threshold 20. Similar to the first gasket member 200, the second gasket member 200 forms a second head portion 220. The second head portion 220 is suitable for insertion into the channel 26 formed by the threshold 20. The second head portion 220 may thus be engaged by the threshold 20 and retained thereby.

In this example, the second gasket member 200 is not symmetrical with respect to turning the second gasket member 200 upside-down. While the plurality of recesses 222, 224, 226 is formed symmetrically by the second portion 210, the second head portion 230 is not symmetrical and may not fit into the channel 26 when the second gasket member 200 is upside-down, or may not be suitably retained if fitted into the channel 26.

Figure 3:
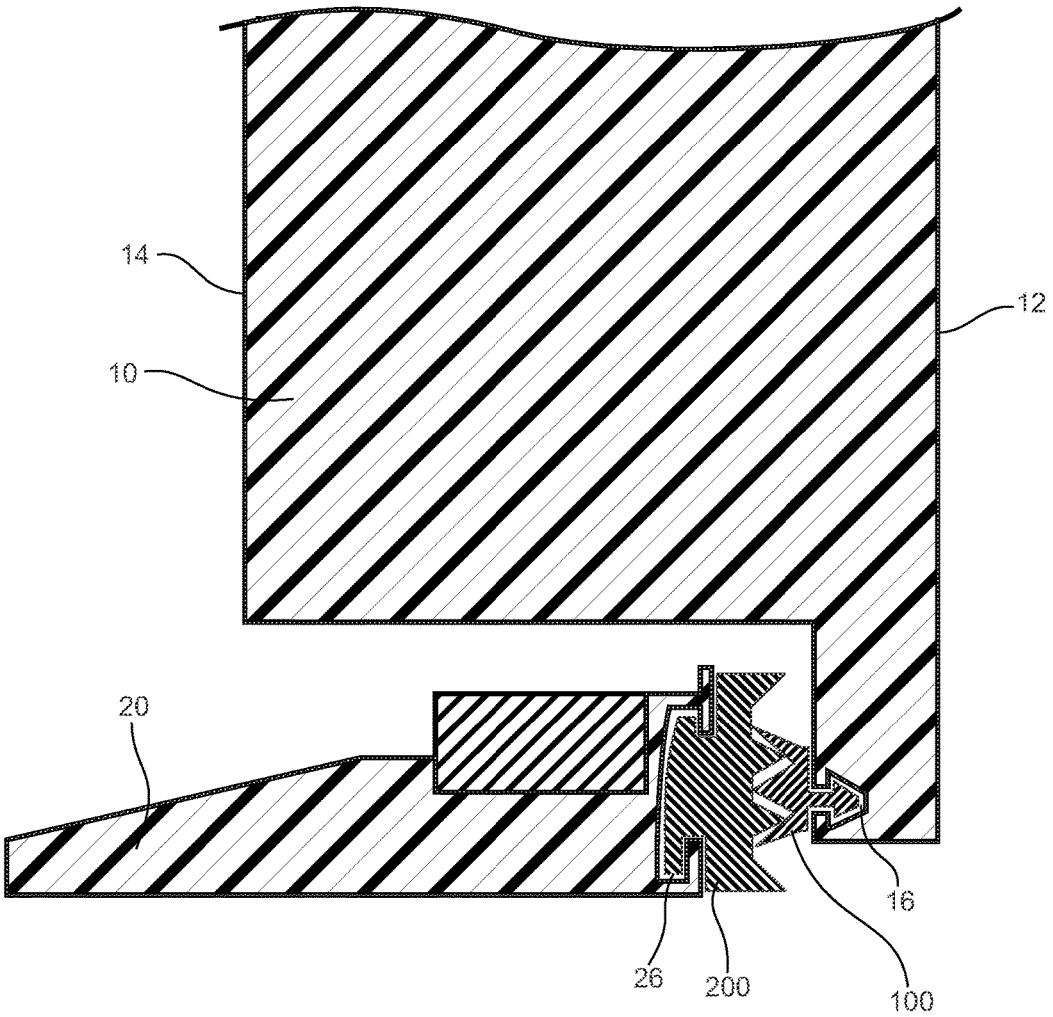
FIG. 3 shows a cross-sectional view of an embodiment of a flood seal arrangement according to the present invention provided on a door that is closed.

FIG. 3 shows a cross-sectional view of the door assembly provided with the flood seal arrangement, where the door leaf 10 is in a closed position.

The flood seal arrangement is configured such that, when the door assembly is closed, a seal is formed. Suitably, when the door leaf 10 is moved to the closed position, the first gasket member 100 is moved to engage the second gasket member 200.

When the seal is formed, the plurality of protrusions 122, 124, 126 is arranged to engage the second gasket member 200. In one example, when the seal is formed, the first gasket member 100 and the second gasket member 200 may be deformed. Suitably, the first gasket member 100 and the second gasket member 200 are made from resiliently deformable material. In particular, the plurality of protrusions 122, 124, 126 may be pressed against the second portion 210 forming the plurality of recesses 222, 224, 226. Thereby both gasket members may be deformed.

When the seal is formed, the plurality of protrusions 122, 124, 126 may be substantially deformed while the second portion 210 may be moderately deformed. Suitably, the plurality of protrusions may be less resilient than the second portion 210. Alternatively or additionally, the protrusions 122, 124, 126 may be comprised of protrusions which are generally longer than the depth of the recesses 222, 224, 226.

Advantageously, the first gasket member 100 and the second gasket member 200 may complement one another when forming the seal. Suitably, one protrusion 122, 124, 126 may be received in one recess 222, 224, 226 when the seal is formed.

Figure 4:
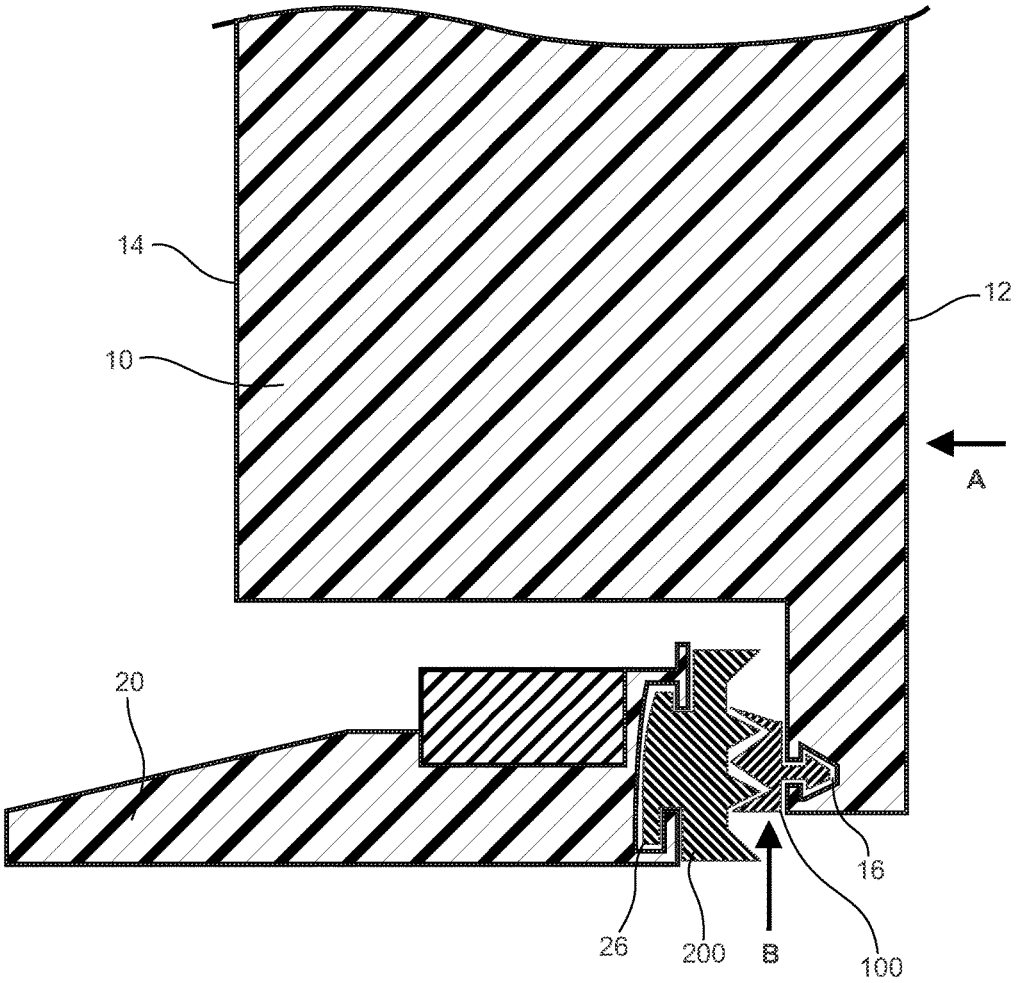
FIG. 4 shows a cross-sectional view of an embodiment of a flood seal arrangement according to the present invention provided on a door that is closed, where the flood seal arrangement is deformed due to water pressure.

FIG. 4 shows a cross-sectional view of the door assembly provided with the flood seal arrangement, where the door leaf 10 is in a closed position and the flood seal arrangement is deformed in response to pressure exerted by flood water.

During a flood, flood water may be pressing against the door assembly and particularly against the door leaf 10 and the flood seal arrangement. In this example, the door leaf 10 is configured for outward opening. In response to water pressure being exerted against the door leaf 10, the door leaf 10 is urged against the threshold 20 and the first gasket member 100 is urged against the second gasket member 200. An arrow A indicates a direction along which along which water pressure may act on the door leaf 10. Advantageously, this may improve the seal formed as the flood seal assembly is compressed by the water pressure. In particular, water may press the first gasket member 100 against the second gasket member 200 and thereby improve the seal formed.

Water pressing directly against the flood seal arrangement may improve the seal formed. In this example, the door leaf 10 is arranged for outward opening. Thus flood water may first press against the protrusion 122. An arrow B indicates a direction along which water pressure may act directly on the flood seal arrangement. Specifically, water pressure may urge the protrusion 122, which is located in the recess 222, against the second portion 210. Further deformation of the protrusion 122 may be prevented by the second portion 210. Thereby, water pressure may press the protrusion 122 against the second portion 210 and improve the seal.

In this example, the protrusion 122 is configured to resist a pressure exerted by flood water. Suitably, the protrusion 122 is directed away from the protrusion 126. Thereby flood water may be hindered from flowing past the protrusion 122, so that the seal may be improved.

Similar to what was described above in relation to the protrusion 122, water pressure may force the protrusion 126, which is located in the recess 226 against the second portion 210. Further deformation of the protrusion 126 may be prevented by the second portion 210. Suitably, the second portion 210 may be relatively stiff. Thereby water pressure exerted onto the flood seal arrangement may improve the seal which is formed between the first gasket member and the second gasket member.

In another example, considering an inwardly opening door, the protrusions 124 and 126 would be urged to press against the second portion 210. In this example, the protrusions 124 and 126 may be forced to bend into a direction which is opposite to the direction indicated by the arrow B. Thereby, regardless of whether the door assembly is configured for outward opening or inward opening, the seal formed by the flood seal arrangement may be improved in response to water pressure being exerted upon the flood seal arrangement.

Figure 5:
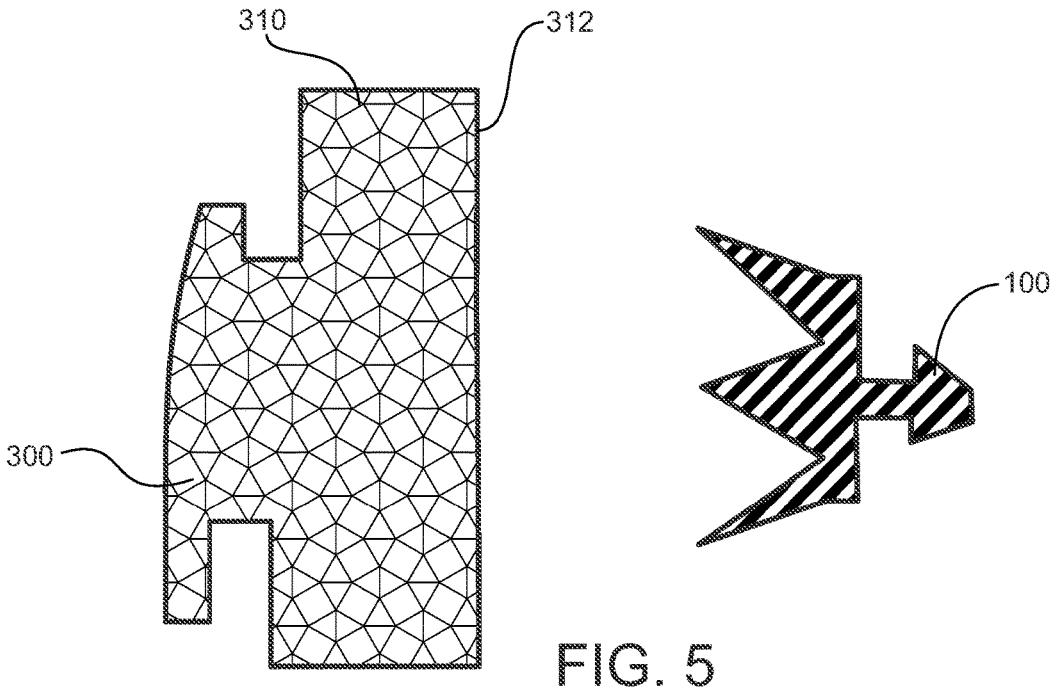
FIG. 5 shows a cross-sectional view of another embodiment of a flood seal arrangement according to the present invention.
Figure 6:
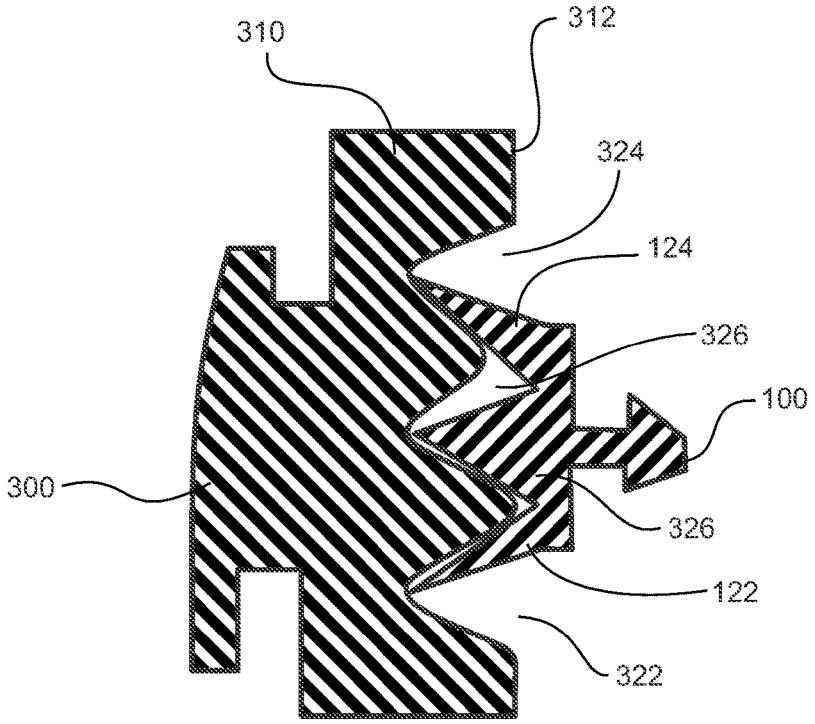
FIG. 6 shows a cross-sectional view of another embodiment of a flood seal arrangement according to the present invention.

FIGS. 5 and 6 show a second embodiment of a flood seal arrangement according to the present invention.

In this example, the first gasket member 100 may be substantially as described before in relation to FIGS. 1 to 4.

In this example, there are no preformed recesses extending into a second gasket member 300. The second gasket member 300 comprises a second portion 310 forming a second surface 312. The second surface 312 may be substantially planar.

In this example, the second portion 310 is resiliently deformable. That is, the second portion 310 is deformable in response to a pressure. Further, the second portion 310 is configured to assume a shape generally corresponding to a shape prior to the deformation once the pressure is lifted. The second portion 310 is resiliently deformable. That is, a first shape of the second portion 310 is deformable to a second shape and, in the second shape, the second portion 310 is configured to assume a shape generally corresponding to the first shape. Suitably, as shown FIG. 5, the second portion 310 member may be made from a semi-closed cell foam. In one example, the second gasket member 300 may be made from semi-closed cell foam.

FIG. 6 shows the first gasket member 100 and the second gasket member 300 brought together to form a seal.

The first gasket member 100 and the second gasket member 300 are configurable such that the protrusions 122, 124, 126 are located in recesses 322, 324, 326. In particular, the second portion 310 is deformable by the protrusions 122, 124, 126. Suitably, the second portion 310 may be made from a material which is easier to compress compared to the first gasket member 100. In one example, the second gasket member 300 and the first gasket member 100 are resiliently deformable, and the first gasket member 100 may be more resilient than the second gasket member 300.

During a flood, water pressure may have substantially the same effect on the flood seal arrangement as was described above in relation to another embodiment. In particular, water pressure may urge the protrusion 122, 124 against the second portion 310 and thereby improve the seal formed between the first gasket member 100 and the second gasket member 300. In one example, where the seal is provided on a door leaf 10, which is configured for outward opening, water pressure may further compress the flood seal arrangement. Specifically, water pressure may urge the door leaf 10 against the threshold 20 so that the first gasket member 100 is urged against the second gasket member 300. Thereby the seal formed by the first gasket member and the second gasket member may further be improved.

In summary, exemplary embodiments of a flood seal arrangement have been described. The flood seal arrangement is suitable for forming a seal between a door leaf and a threshold of a door. The flood seal arrangement is particularly suitable for use with a low threshold door.

The flood seal arrangement may be manufactured industrially. An industrial application of the example embodiments will be clear from the discussion herein.

Although preferred embodiment(s) of the present invention have been shown and described, it will be appreciated by those skilled in the art that changes may be made without departing from the scope of the invention as defined in the claims.

The invention claimed is:

1. A flood seal arrangement, comprising:

a first gasket member forming a first portion, an outermost protrusion, and a neighbouring protrusion adjacent to the outermost protrusion, wherein the outermost protrusion and the neighbouring protrusion extend from the first portion, and a second gasket member forming a second portion;

wherein the first and the second gasket member are engageable along a closing direction to form a flood seal having a dry side, wherein the outermost protrusion is located in a recess extending into the second portion and the outermost protrusion is sized so as to deform once engaged to form the flood seal;

wherein the first and the second gasket member are separable to break the flood seal and to remove the protrusion from the recess; and wherein the outermost protrusion projects away from the neighbouring protrusion and is flexible in a direction transverse the closing direction such that outermost protrusion deforms away from the dry side when the flood seal is formed.

2. The flood seal arrangement according to claim 1, wherein the outermost protrusion is located in the recess, a deformation of the outermost protrusion is opposed by the second portion.

3. The flood seal arrangement according to claim 1, wherein the recess is preformed.

4. The flood seal arrangement according to claim 1, wherein the second gasket member comprises semi-closed cell foam.

5. The flood seal arrangement according to claim 4, wherein the first gasket member and the second gasket member are configurable such that the protrusions of the first gasket member are located in a plurality of recesses in the second gasket member.

6. The flood seal arrangement according to claim 5, wherein the plurality of recesses comprises recesses which are spaced uniformly.

7. The flood seal arrangement according to claim 1, wherein the first and the second gasket member are resiliently deformable.

8. The flood seal arrangement according to claim 7, wherein the second gasket member is more resilient than the first gasket member.

9. A door assembly comprising the flood seal arrangement according to claim 1, the door assembly comprising a threshold and a door leaf;

wherein the first gasket member is provided on the door leaf and the second gasket member is provided on the threshold, wherein the door assembly is configurable such that the first gasket member engages the second gasket member.

10. A door assembly as claimed in claim 9, wherein the door leaf is outward opening.

* * * * *